United States Patent [19]

Vetter

[11] 3,992,850

[45] Nov. 23, 1976

[54] APPARATUS FOR PACKING MATERIALS IN SYNTHETIC FOILS

[75] Inventor: Arthur Vetter, Groenenbach, Germany

[73] Assignee: Multivac Sepp Haggenmueller KG, Germany

[22] Filed: Feb. 27, 1976

[21] Appl. No.: 661,962

Related U.S. Application Data

[62] Division of Ser. No. 467,861, May 8, 1974.

[30] Foreign Application Priority Data

May 9, 1973 Germany ..... 2323409

[52] U.S. Cl. ..... 53/112 R; 53/86; 53/112 A

[51] Int. Cl.[2] ..... B65B 31/02

[58] Field of Search ..... 53/112 R, 112 A, 86, 53/89, 94; 141/65; 426/232

[56] References Cited

UNITED STATES PATENTS 3,643,586 2/1972 Robinson ..... 53/86 X 3,659,393 5/1972 Richter ..... 53/112 AX

*Primary Examiner*—Travis S. McGehee

*Attorney, Agent, or Firm*—W. G. Fasse; W. W. Roberts

[57] ABSTRACT

In the present method and apparatus materials such as hot and/or liquid foodstuffs are sealed into pouches or containers formed between layers or foils of a synthetic material, whereby gas above the material is evacuated prior to sealing of the containers or pouches. In order to avoid splashing of the material onto the sealing surfaces of the foils, the temperature of the material is measured just before the sealing step. The vacuum is adjusted as a function of the measured temperature to inhibit boiling of the material being packed and thus preventing the splashing of the material.

4 Claims, 5 Drawing Figures

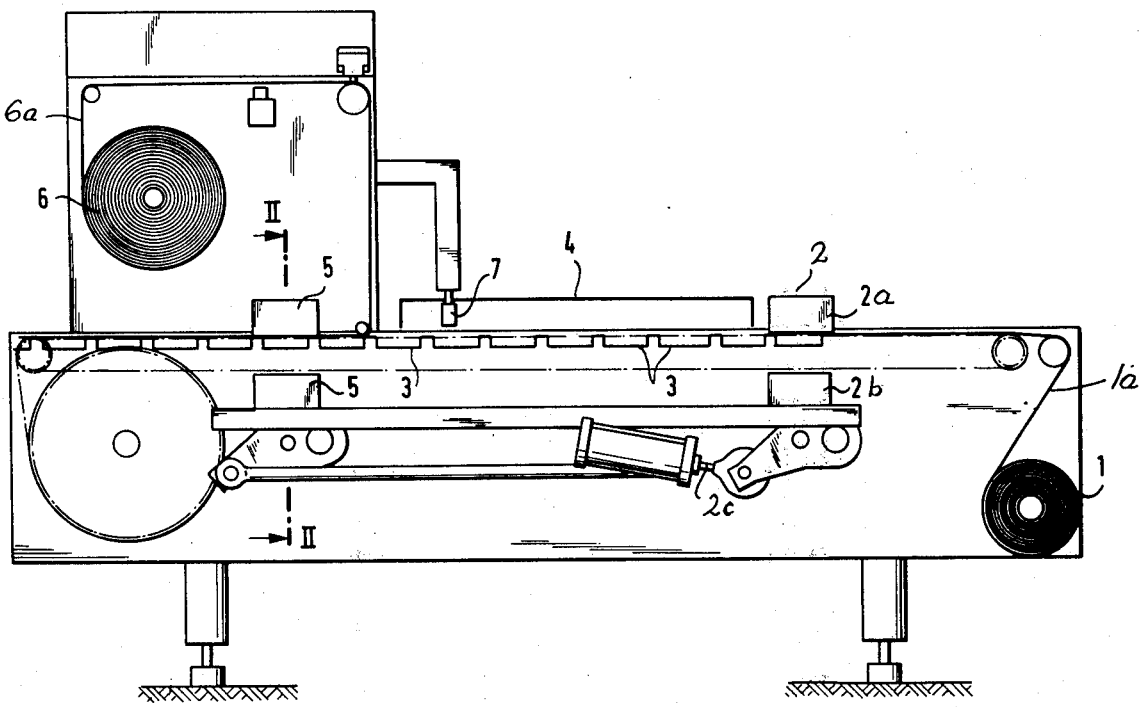

APPARATUS FOR PACKING MATERIALS IN SYNTHETIC FOILS

This is a division of application Ser. No. 467,861 filed May 8, 1974.

BACKGROUND OF THE INVENTION

This invention relates to a method and apparatus for packing materials between foils of a synthetic material, of the type wherein a material to be packed is filled into a container formed in one foil web, and the space above the material is evacuated to remove oxygen containing gas prior to the sealing of the container with another foil web. The invention is particularly directed to the packing of materials which tend to splash when boiling.

Hot and liquid materials, especially prepared meals, should be packed in such a manner that the optimal quality of the material is preserved until it is to be consumed. In the past, food has commonly been permanently preserved by packaging in rigid tin cans, although at the present time it is becoming increasingly popular to package foods or meals by means of compound foils. Compound foil packages of synthetic material, which enclose prepared meals or parts of meals should be designed to preserve the material for a certain period of time. In addition, the packing should also be designed to be appealing, in order to promote the sales of the packages.

In one known device for packing foods in foils of synthetic material, a bottom foil web is fed from a first roll to a station in the device which includes a molding tool. The bottom foil web is heated, and then molded in the lengthwise and crosswise directions to form one or more rows of containers. These containers are then fed to a second station of the device, wherein they are filled with the desired material. The filled containers are then fed to a third station of the device. A top foil web is fed to the third station from a second roll and in the third station the top foil web is positioned over the bottom foil web. The filled container is then evacuated and the top foil web is sealed to the bottom foil web. The container is frequently heated to a high temperature following the sealing of the container, in order to sterilize the contents within the container.

When packing prepared meals or parts of meals, it is necessary to fill and pack the material at a temperature that is as high as possible, and also it is necessary to completely remove the air in the container. If the food is not hot just prior to sealing, there is a danger of reinfection of the food by microorganisms following the packaging thereof. It is to be noted that frequently the food being packaged is in liquid form or partly in liquid form.

It is further advantageous to pack the material while it is heated, in order to conserve thermal energy, since the pasteurization or sterilization process frequently immediately follows the packaging step.

In addition, the food being packed is frequently in a heated condition, since it may be filled in the containers just following a process of preparation. In the packaging of prepared meals and components thereof, it is desirable that the packing be effected in an air free manner, in order to obviate oxidation of food components such as fat, coloring, vitamins and flavoring.

It is also desirable to remove the air from the containers prior to sealing, since air bubbles or air inclusions in the food inhibit the transfer of heat energy within the food during any following treatment, such as sterilization or deep freezing, and also when the material is heated in the package prior to consumption.

U.S. Pat. No. 2,620,111 discloses the replacement of air in a packing container with steam or an inert gas. When the air in the container is replaced with steam, the steam condenses and a vacuum may be produced by this technique.

German Patent Publication 1,561,956 discloses a process for packing material between packing foils of a synthetic material, wherein the container is sealed by heat sealing the edges thereof following the removal of oxygen containing gas from above the material. Since materials to be packaged in this manner may tend to splash when boiling, a process of this type involves a risk that a portion of the filled material may splash during evacuation of the container, the splashing of the material onto the edges of the container rendering complete sealing of the edges of the container impossible.

OBJECTS OF THE INVENTION

In view of the foregoing, it is the aim of the invention to achieve the following objects singly or in combination:

to overcome the above stated drawbacks of the prior art, and more particularly to provide a process and apparatus for packaging materials between layers of synthetic material wherein perfect sealing of the edges of the containers is possible;

to provide a process for the filling of containers with a material which tends to splash when boiling, wherein the evacuation is automatically adjusted in order to avoid splashing which may inhibit the production of perfect seals; and to provide an apparatus which enables the filling of a liquid material between foils of a synethetic material without incurring the risk of splashing of the material which would inhibit the formation of perfect seals.

SUMMARY OF THE INVENTION

The invention is directed to the process of packing material of the type which tends to splash when boiling, the material being packed in foils of synthetic material which are sealed in an air-tight manner by heat sealing of the edges of containers formed in the foils. Oxygen containing gas which is present above the material is removed by evacuation prior to sealing.

Briefly stated, in accordance with the invention, the above objectives are achieved by providing a process in which the temperature of the material filled in the containers is measured, and the vacuum for evacuating the containers is regulated according to a given steam pressure curve corresponding to the fill material as a function of the measured temperature. The regulation of the vacuum is effected in such a manner that the filled material is maintained just below its boiling point at the time of sealing of the container.

In one embodiment of the process in accordance with the invention, the containers are evacuated following the replacement of oxygen containing gas over the material with steam or an inert gas.

In accordance with a further embodiment of the invention, an apparatus for packing material between foils of a synthetic material comprises a filling station and an evacuation and sealing station. A temperature probe is provided between the filling station and the evacuation and sealing stations in order to measure the temperature of the filled material.

The apparatus of the invention further comprises a controlling system in the evacuation and sealing station for controlling a valve in the evacuation system as a function of the temperature detected by the temperature probe. The controlling system regulates the upper limit of vacuum generated as a function of the steam pressure curve of the filled material, so that the material is not in a boiling condition when it is to be sealed in the containers or pouches.

The controlling system for the apparatus may include an adder connected to receive the output of the temperature probe, the output of the adder being applied to a computer. The computer is provided with internal programming so that its output is in the form of a signal having an amplitude proportional to the admissable steam pressure of the filled material to be evacuated.

In addition, the controlling means may comprise an automatic control system including a comparator element connected to receive the output signal of the computer, a differential amplifier connected to the output of the comparator, and a regulating unit connected to the output of the differential amplifier. The output of the regulating unit is applied to a valve for controlling the vacuum for evacuating the space over the filled material. In addition, the output of the regulating unit is applied by way of a feedback circuit to the second input of the comparator.

BRIEF FIGURE DESCRIPTION

In order that the invention may be more clearly understood, it will now be described, by way of example, with reference to the accompanying drawings, wherein.

Figure 1:
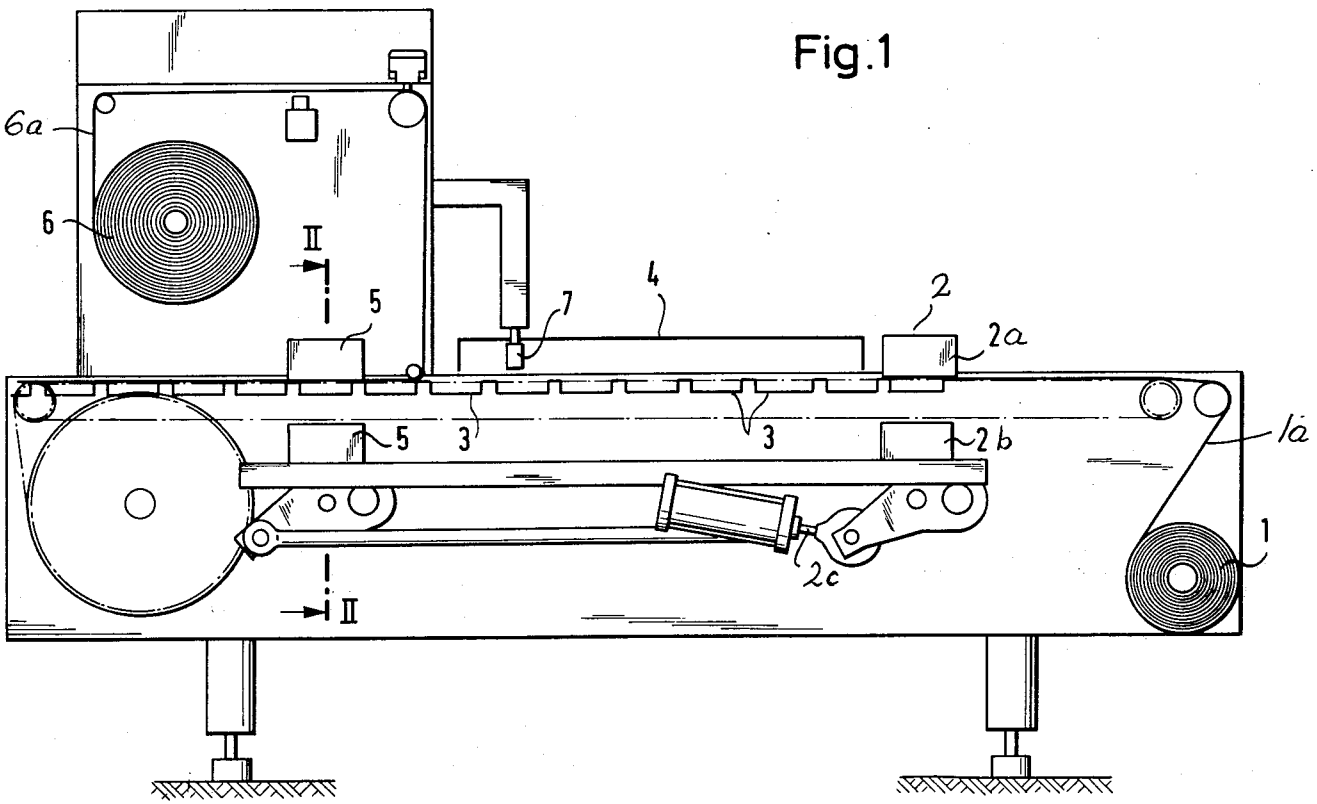
FIG. 1 is a simplified illustration of the side view of an apparatus for the filling of materials between foils of synthetic material in accordance with one embodiment of the invention.
Figure 4:
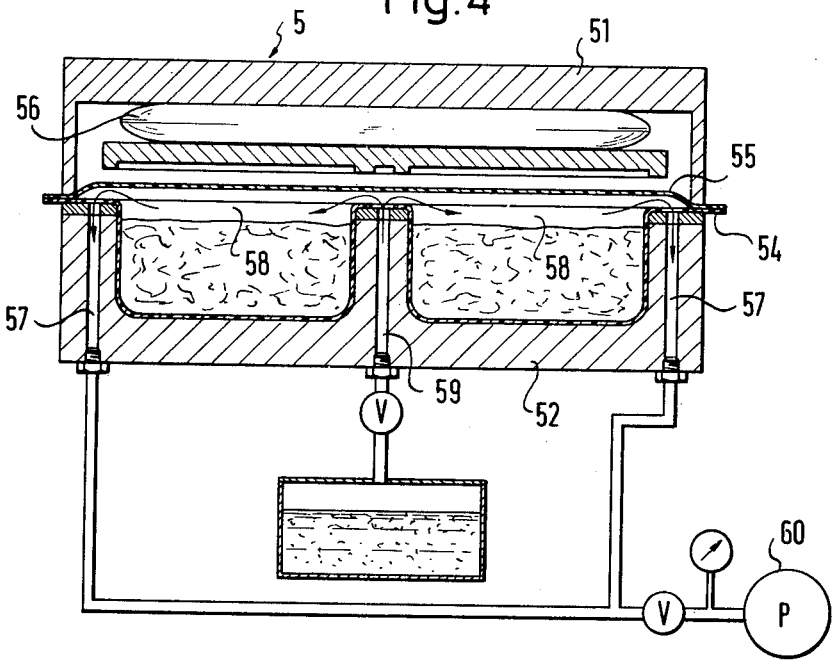
Figure 5:
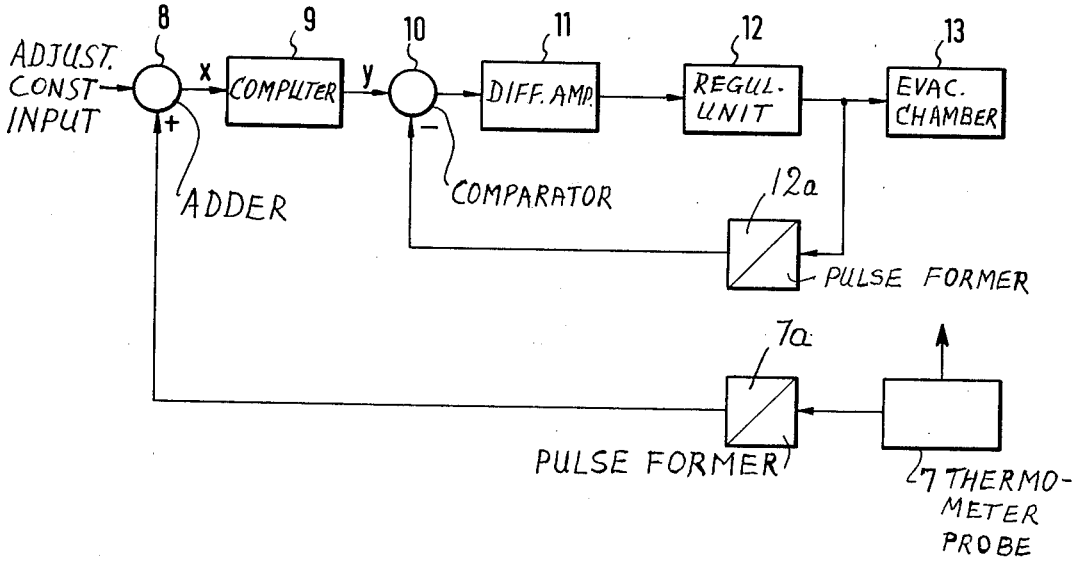

FIG. 4 is a cross sectional view of a further embodiment of the evacuation and sealing station taken along the line II—II of FIG. 1; and FIG. 5 is a block diagram of a system in accordance with the invention for controlling the vacuum applied in the evacuation and sealing station as a function of the measured temperature and the steam pressure curve of the material filled between the foil layers in the filling station.

DETAILED DESCRIPTION OF EXAMPLE EMBODIMENTS

Referring now to FIG. 1, therein is illustrated in simplified form, the side view of an apparatus for packaging hot and liquid material between layers of a synethetic material. The apparatus is provided with a roll 1 of a foil web 1*a* for forming the bottom of the containers. The web 1*a* is fed by way of suitable rollers to a molding station 2 which may include an upper molding member 2*a* and a lower molding member 2*b* for molding the bottoms of containers from the web 1*a*. Suitable actuating means, such as a hydraulically controlled system 2*c* may be provided for controlling the molding elements. It will be understood, of course, that the illustrated embodiment of the molding station is purely exemplary, and other conventional molding stations known in the art may be alternatively employed. In the molding station the bottom web 1*a* is formed consecutively into containers, by shaping the web 1*a* following heating thereof. The containers formed in the web 1*a* are then fed to a filling station 4. The filling station, which may also be of any conventional type, fills the containers 3 with the desired material, such as prepared meals or components thereof. Following the filling of the containers, the containers are fed into an evacuation and sealing station 5.

The apparatus is further provided with a roll 6 of a foil web 6*a* for forming the tops of the containers. The foil 6*a* is drawn from the roll 6 and fed by way of suitable rollers to the evacuation and sealing station 5. In the evacuation and sealing station the space above the filled material in the containers is evacuated, and the upper foil web is sealed onto the lower foil web to effect the sealing of the containers. Various arrangements for this stage will be described in the following paragraphs, with reference to FIGS. 2 to 4.

A temperature probe 7 is provided between the evacuation and sealing station 5 and the filling station 4 in order to enable the measuring of the temperature of the filled material. The measuring of the temperature of the material should occur as soon as possible before the evacuation stations, and consequently, the thermometer probe 7 should be arranged as closely as possible to the evacuation and sealing station. The thermometer probe 7, which may be of any conventional type providing, for example, an electrical output proportional to the temperature of the filled material may, for example, be disposed so that it may contact the filled material at the desired location.

In accordance with the invention, as will be described in greater detail in the following paragraph, the upper limit of the vacuum generated in the vacuum station 5 is adjusted as a function of the boiling point of the filled material resulting from the steam pressure curve, so that the material is not in a boiling condition prior to sealing. As a consequence, the vacuum is adjusted to be as high as possible without effecting the boiling of the material and the splashing of the material onto the edges of the containers. By this means, in accordance with the invention, the edges of the containers do not become contaminated with the filled material, and a perfect sealing of the containers may be reliably obtained in the sealing step. While the vacuum may be adjusted automatically, in accordance with the following disclosure, it will also be apparent that the adjustment may be effected manually by an operator taking into consideration the temperature of the filled material and the characteristics of the filled material.

In one embodiment of the invention a transducer (not shown) may be provided between the temperature probe and the evacuation and sealing station. This transducer may be provided with a program disk in order to allow for the physical properties of the filled material.

Referring now to FIG. 5 therein is illustrated a block diagram of a preferred embodiment of an automatic control system which may be employed in accordance with the invention between the thermometer probe 7 and the evacuation and sealing station 5. The output of the thermometer probe 7 is connected, for example, by way of an adjustable constant amplifier 7*a* to one input of an adder 8. A suitable source of an adjustable constant signal may be applied to the other input of the adder 8. The output of the adder 8 is applied as an input to a computer circuit 9. The output of the computer circuit is applied to one input of a comparator 10. The output of the comparator 10 is applied to a differential amplifier 11, and the output of the differential amplifier 11 is applied to a regulating unit 12. The output of the regulating unit 12 is applied by way of a feedback circuit 12*a* to the second input of the comparator 10. The comparator 10, differential amplifier 11, and regulating unit 12 comprise an automatic vacuum control system. The pressure output of the regulating unit 12 is applied to the evacuation chamber 13 of the evacuation and sealing station.

In the arrangement of FIG. 5, the signal proportional to the temperature of the filled material is applied from the thermometer probe 7, by way of transducer or pulse former 7*a*, to one input of the adder or comparator circuit 8. An adjustable constant input signal may be applied to the other input of the comparator or adder 8. The computer 9, on the basis of its input signal, provides an output signal having an amplitude proportional to the necessary steam pressure of the material to be evacuated, as a function of the temperature of the filled material. Suitable constants may be introduced into the system, for example, by way of the second input to the comparator or adder 8, so that the output of the computer is properly adjusted with respect to the specific type of material filled into the containers. In another embodiment of the invention the computer may be replaced by a device having interchangeable cam disks representing with its shape the physical properties of the filled material, whereby the position of the cam disk is determined by the temperature detected by the thermometer probe, so that the radial length of the cam at a suitable cam follower detector provides an output signal proportional to the steam pressure of the material to be evacuated.

The output of the computer 9 is applied to the automatic vacuum control system, including the comparator 10, differential amplifier 11 and regulating unit 12 as the control value of the vacuum to be generated in the evacuation chamber. The degree of the vacuum to be generated in the evacuation chamber of the evacuation and sealing unit is thus adjustable by means of the automatic control system as a function of the measured temperature of the filled material and hence to keep the material just below the boiling point. More specifically, the evacuation of the containers always occurs to a degree of vacuum just under that at which the filled material would start to splash whereby such splashing is avoided.

Figure 2:
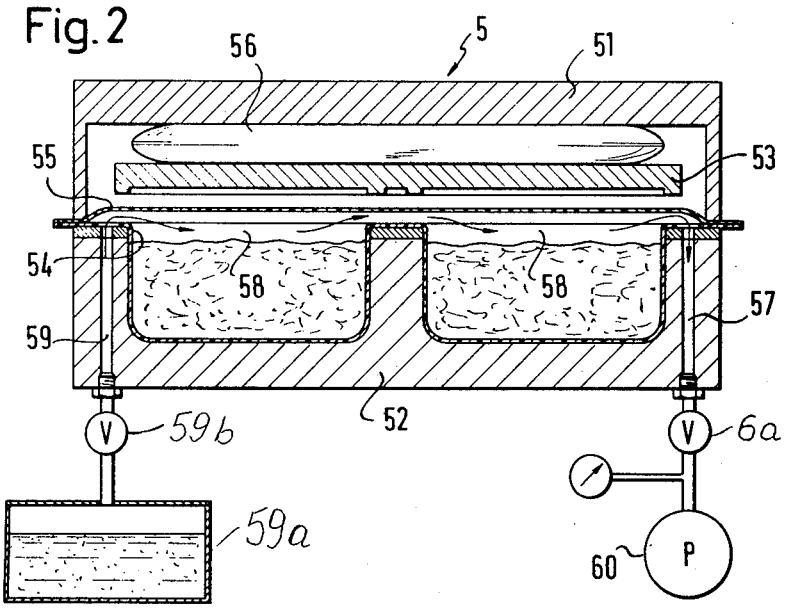
FIG. 2 is a cross sectional view of one embodiment of an evacuation and sealing station taken along the lines II—II of FIG. 1.
Figure 3:
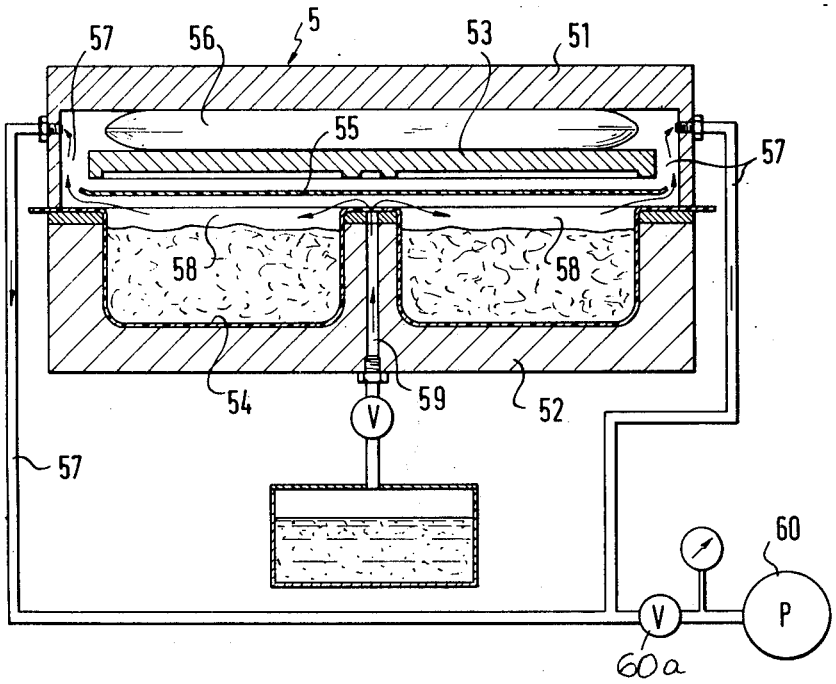
FIG. 3 is a cross sectional view of a second modification of an evacuation and sealing station taken along the line II—II of FIG. 1.

FIGS. 2, 3, and 4 illustrate in cross sectional views, three different embodiments of the evacuation and sealing station 5 which may be employed in accordance with the invention. In these figures corresponding elements are denoted by the same reference numerals.

In FIGS. 2, 3, and 4 the evacuation and sealing station 5 comprises an upper tool member 51 and a lower member 52. The lower tool member 52 is provided with suitable recesses for forming the containers of the lower web 54. A sealing tool 53 is provided in the space between the upper and lower tool members, the sealing tool being arranged to contact the top of the upper foil web 55 in selected regions in order to seal the upper and lower foils together, for example by heat sealing, around the edges of the containers. The sealing tool 53 is provided with suitable conventional heating means.

In the arrangement of FIGS. 2 to 4, the sealing tool is actuated in a known manner by a pneumatic element 56 positioned between the top of the sealing tool 53 and the upper tool part 51. Thus, upon actuation, the sealing tool 53 is forced downwardly to effect the heat sealing of the foil webs.

FIGS. 2 to 4 also illustrate a pipeline 57 extending from the hollow space 58 to be sealed above the filled material to a vacuum pump 60, by way of a valve 60*a*. The valve 60*a* is adapted to be controlled, for example, by the control system of FIG. 5. Alternatively, of course, the valve 60*a* may be manually controlled as a function of the output of the thermometer probe 7.

The process of evacuating and sealing the containers may be effected in such a manner that, simultaneously with the removal of the oxygen containing gas above the filled material by suction due to the vacuum in the hollow space 58, the oxygen containing gas is replaced by steam or an inert gas. For this purpose, the device may be provided with an inlet pipe 59 extending from the space 58 to a source 59*a* of steam or an inert gas, by way of a suitable valve 59*b*.

In the embodiment of the invention illustrated in FIG. 2, the suction pipe 57 and the inlet pipe 59 extend through the lower tool member 52 to enter the hollow space 58 in the region of the edges of the containers. In this arrangement, the bottom foil web 54 is provided with openings aligned with the suction pipeline 57 and inlet pipe 59, so that the evacuation of steam and air or the introduction of steam can occur by way of these openings.

In the embodiment of the invention illustrated in FIG. 3, the suction pipeline 57 extends through the wall of the upper tool member 51, while the inlet pipe 59 extends through the lower tool member 52 to a position between a pair of containers. In this arrangement, in order to permit evacuation of the hollow space 58, the upper foil web 55 must be sufficiently narrow that the air from the hollow space 58 can escape around its edges to the pipeline 57. Thus, as opposed to the arrangement of FIG. 2, the upper and lower tool members 51 and 52 only hold the lower web, whereas in FIG. 2 the upper and lower tool members hold both of the webs together.

In the arrangement of the invention illustrated in FIG. 4, two pipelines 57 are illustrated extending through the lower tool member 52 to points in the hollow space 58 adjacent the outside edges of a pair of side by side containers.

The inlet pipe 59 extends through the lower tool member 52 to a point between a pair of side by side containers. This arrangement is otherwise similar to the arrangement of FIG. 2.

The replacement of the oxygen containing air above the filled material with steam permits a substantially faster removal of the oxygen containing air. In addition, this technique requires a lower vacuum than would be otherwise required since, in spite of the presence of a residue of gas (steam), no oxygen is present above the filled material, and the vacuum in the sealed space is increased by the subsequent condensation of the steam. This method also reduces the danger of subsequent breaking of the package during further heat treatment, such as, for example, during sterilization or pasteurization. The reliability of the process is thereby increased. This portion of the process is per se known. In accordance with the present invention, however, the extent of the vacuum is controlled as a function of the temperature of the filled material, so that the vacuum does not exceed a degree which would effect boiling and hence splashing, of the liquid material. As a consequence, the danger of splashing of the liquid material onto the edges to be sealed is minimized, whereby perfect sealing of the edges of the containers is reliably effected.

Although the invention has been described with reference to specific example embodiments, it is to be understood, that it is intended to cover all modifications and equivalents within the scope of the appended claims.

What is claimed is:

1. In an apparatus for packing materials which tend to splash when boiling, said apparatus being of the type including means for packing material in packing foils of synthetic material, means for sealing the packed material in the foils in an air-tight manner by heat sealing the synthetic material surrounding the packing material, and means for evacuating the space above the packed material; the improvement comprising means for measuring the temperature of said packed material prior to the evacuation of space above the packed material, and means coupled to said temperature measuring means for adjusting the vacuum employed in evacuating said space in accordance with a steam pressure curve corresponding to said filled material as a function of the temperature measured by said temperature measuring means for maintaining the vacuum just below the vacuum at which said packed material boils.

2. The apparatus of claim 1, in which said evacuating means comprises an evacuation chamber and a valve connected between said evacuation chamber and said space above the packed material, wherein said vacuum adjusting means is coupled to operate said valve for regulating the upper limit of the vacuum applied to said space as a function of the temperature measured by said temperature measuring means and the steam pressure curve of said packed material.

3. The apparatus of claim 2, wherein said vacuum adjusting means comprises comparator means coupled to said temperature measuring means, computer means coupled to said comparator means for providing an output signal having an amplitude proportional to the admissable steam pressure of the packed material to be evacuated, and an automatic control system coupled to the output of said computer for controlling said valve.

4. The apparatus of claim 3, wherein said automatic control system comprises a second comparator element coupled to the output of said computer, a differential amplifier coupled to the output of said second comparator, a regulating unit coupled to the output of said differential amplifier, means applying the output of said regulating unit to said second comparator as a second input thereof, and means applying the output of said regulating unit to said valve.

* * * * *